340-566
11/29/83 XR 4,418,337 SR

United States Patent [19]
Bader

[11] 4,418,337
[45] Nov. 29, 1983

[54] ALARM DEVICE

[75] Inventor: Ramzi N. Bader, West Covina, Calif.

[73] Assignee: Spectrol Electronics Corporation, City of Industry, Calif.

[21] Appl. No.: 289,625

[22] Filed: Aug. 3, 1981

[51] Int. Cl.[3] ..... G08B 13/14
[52] U.S. Cl. ..... 340/571; 340/384 E; 340/566; 340/691; 340/693; 340/573
[58] Field of Search ..... 340/566, 571, 573, 575, 340/384 E, 691, 692, 326, 327

[56] References Cited

U.S. PATENT DOCUMENTS

| | | | |
|---|---|---|---|
| 2,286,897 | 6/1942 | Costa et al. | 171/209 |
| 2,890,438 | 12/1954 | Bardeen | 340/17 |
| 3,239,804 | 3/1966 | Elskamp et al. | 340/17 |
| 3,474,680 | 10/1969 | Babson et al. | 73/517 |
| 3,547,106 | 12/1970 | Bornmann | 128/2 |
| 3,614,763 | 10/1971 | Yannuzzi | 340/279 |
| 3,633,053 | 1/1972 | Peters | 340/17 |
| 3,924,262 | 12/1975 | Melancon | 340/384 E |
| 3,953,829 | 4/1976 | Boyle | 340/17 |
| 4,012,732 | 3/1977 | Herrick | 340/279 |
| 4,023,056 | 5/1977 | Yamada et al. | 310/15 |
| 4,110,741 | 8/1978 | Hubert et al. | 340/573 |
| 4,196,429 | 4/1980 | Davis | 340/669 |
| 4,234,876 | 11/1980 | Murai | 340/566 X |
| 4,237,448 | 12/1980 | Weinberg | 340/384 E |

*Primary Examiner*—David L. Trafton
*Attorney, Agent, or Firm*—David L. Adour

[57] ABSTRACT

An alarm device for monitoring the movements of a person is disclosed. The device is designed to be attached to a person's clothing and is particularly suitable for use by an emergency worker, such as a fireman. The device comprises a motion sensor, a signal processing circuit on a printed circuit board, and an alarm, all contained within a housing. The motion sensor includes a permanent magnet attached to one end of a spring located within an induction coil wound on a bobbin. The other end of the spring is attached to the printed circuit board so that a voltage is induced across the coil due to vibrations of the magnet relative to the coil in response to movements of the housing of the device. The signal processing circuit activates the alarm to generate an alarm signal if the person is immobile, for example, as the result of an injury, for a predetermined period of time.

10 Claims, 4 Drawing Figures

ALARM DEVICE

BACKGROUND OF THE INVENTION

The present invention relates to a motion detector for monitoring the movement of a body, and more particularly relates to an alarm device for monitoring the activity of a person to provide an alarm signal if the person becomes immobile as a result of an injury.

There are many situations in which an alarm device is useful. For example, a person working in a dangerous environment, such as a fireman or miner, may attach such a device to his clothing to monitor his movements. If the worker is injured and thereby immobilized, the device provides an alarm signal to summon aid for the injured worker. Also, an elderly person may desire to wear such a device to summon aid if he is immobilized due to an injury. Furthermore, an alarm device may be adapted for use in a variety of other situations. For example, the device may be adapted for use as a security device for an inanimate body, such as a motor vehicle, to detect unauthorized movement of the inanimate body.

Many different types of motion detectors are known which may be used as an alarm device. However, in large part, these detectors do not have a motion sensor having a three axis motion sensing capability and the sensitivity of their motion sensors is not easily adjustable. Also, these detectors may be complex and bulky in structure, expensive to manufacture, and are not light weight. Additionally, these detectors usually are not watertight and shock resistant and, in general, are not suited for use in unfavorable environments. Furthermore, these detectors may require frequent maintenance and/or replacement and are not capable of testing themselves to ensure that they are operating properly. Still further, these detectors may generate false alarm signals due to momentary inactivity by a person wearing the detector. Still further, these detectors, usually do not have alarms which generate a warning signal, before a high level alarm signal is generated, so that a person wearing the detector can act to prevent activation of the high level alarm signal when the person desires to remain motionless for a long time period. Also, these detectors usually do not have an alarm which may be manually operated. These disadvantages limit the situations in which these motion detectors may be used.

SUMMARY OF THE INVENTION

Therefore, an object of the present invention is to provide a motion detector, having a three axis motion sensing capability, which may be used as an alarm device for monitoring the activity of a person or article.

Another object of the present invention is to provide a motion detector having a motion sensor with easily adjustable sensitivity.

Another object of the present invention is to provide a motion detector which is simple, inexpensive, compact and reliable.

Another object of the present invention is to provide a motion detector which is watertight and shock-resistant and is, in general, capable of operating in unfavorable environments.

A further object of the present invention is to provide a motion detector which is self-testing.

A still further object of the present invention is to provide a motion detector which operates in either a manual or automatic mode.

A still further object of the present invention is to provide an alarm device, for monitoring the activity of a person, which prevents false alarms due to momentary inactivity by the person wearing the device.

A still further object of the present invention is to provide an alarm device, for monitoring the activity of a person, having an alarm which generates a warning signal, before a high level alarm signal is generated, so that the person wearing the detector can act to prevent activation of the high level alarm signal when the person desires to remain motionless for a long time period.

These and other objects of the present invention are attained by an alarm device comprising a motion sensor, a signal processing circuit on a printed circuit board, and an alarm, such as a horn, which all are contained within a compact housing. The housing is attached with a fastener to a body, such as a person or article, whose motion is to be monitored. The housing is watertight and shock resistant and, in general, is designed for use in unfavorable environments.

In operation, when the device is used as an alarm device for monitoring the activity of a person, the signal processing circuit controls the alarm in response to electrical signals from the motion sensor. If the motion sensor detects movements then the alarm is maintained inoperative by the signal processing circuit. However, if movements are not detected by the motion sensor, then, after a predetermined time delay, the signal processing circuit operates the alarm to generate a low level alarm signal. This time delay prevents spurious activation of the device due to momentary periods of inactivity by a person wearing the device. If, after another time delay, the motion sensor still detects no movements, then the signal processing circuit operates the alarm to generate a high level alarm signal. This second time delay allows the person wearing the device time to act to prevent activation of the high level alarm signal when the person desires to remain motionless for a long time period.

The motion sensor comprises a coil surrounding a permanent magnet supported on a spring connected to the printed circuit board which is contained within the housing of the alarm device. This sensor is compact, simple and reliable. Movements of a body, to which the device is attached, result in moving the permanent magnet within the coil to induce voltages across the coil. These induced voltages are monitored by a motion sensing circuit which is part of the signal processing circuit. The motion sensing circuit generates a first electrical signal in response to movements of the body and a different, second electrical signal in response to absence of movements of the body.

In addition to the motion sensing circuit, the signal processing circuit comprises a motion sensor signal processing circuit, a test circuit, including a deactivation circuit, an operating mode switch circuit, and an on-off switch circuit. The motion sensor signal processing circuit comprises a main timer circuit, an oscillator circuit, and a prewarn timer circuit. The main timer circuit activates the oscillator circuit, after a predetermined time delay, in response to the electrical signal generated by the motion sensing circuit which indicates that the body to which the device is attached is not moving at all or is not moving enough for the motion sensing circuit to detect the movement. When the oscillator circuit is activated it initially provides a relatively low voltage output signal to the alarm to generate a low level alarm signal. The prewarn timer circuit provides a second time delay after which the alarm is switched from the low level to a high level alarm signal. The oscillator circuit is designed to operate the alarm so that both the high and low level alarm signals are pulsating type signals.

The operating mode switch circuit switches the device between an automatic mode and a manual mode of operation. In the automatic mode the device automatically provides an alarm signal in response to a preselected period of inactivity by the body whose motion is being monitored. In the manual mode the alarm signal is generated regardless of whether the body is not moving. The on-off switch circuit controls the flow of electrical power from a battery to the device so that the device operates only when the switch is on.

When the device is turned on in the automatic mode the test circuit and deactivation circuit operate to test the battery, the motion sensor signal processing circuit components, the alarm, and the motion sensor. The deactivation circuit deactivates the motion sensor for a short time period when the device is turned on in the automatic mode. During this short time period the test circuit generates a test signal to briefly activate the motion sensor signal processing circuit to generate a single high level voltage output signal followed by a single low level voltage output signal. If the battery and alarm are operating properly these voltage output signals generate a high and low level alarm signal, respectively. However, if the battery is supplying a low voltage the device locks in a continuous high level alarm signal. Also, at the end of this short time period when the deactivation circuit ceases operation, an alarm signal is locked in if the motion sensor does not properly operate to deactivate the motion sensor signal processing circuit.

BRIEF DESCRIPTION OF THE DRAWINGS

Other objects and advantages of the present invention will be apparent from the following detailed description in conjunction with the accompanying drawings, wherein like reference numerals identify like elements, and in which.

DESCRIPTION OF THE PREFERRED EMBODIMENT

Figure 1:
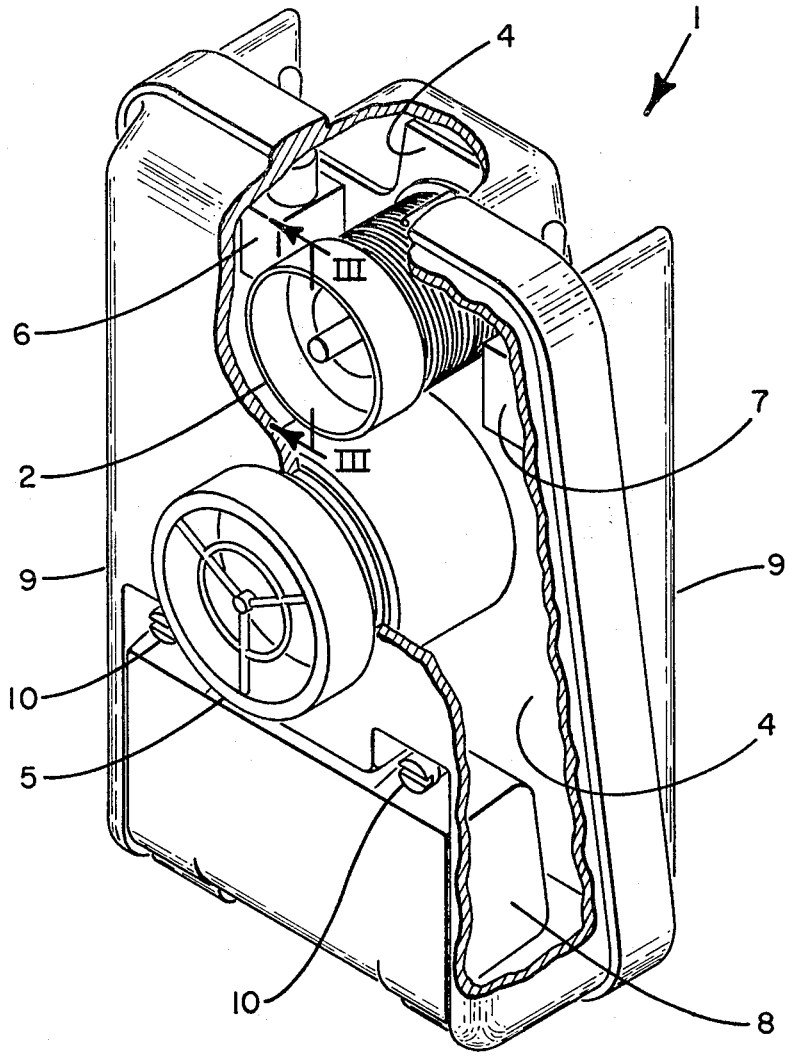
FIG. 1 is a schematic perspective view of an alarm device constructed according to the principles of the present invention

Referring to FIG. 1, an alarm device 1 constructed according to the principles of the present invention, is schematically illustrated. The device comprises a motion sensor 2, a printed circuit board 4, and a horn 5, which are all in a housing 9. The signal processing circuit of the device 1 is located on the printed circuit board 4. A battery 8, located within the housing 9 and held in place by screws 10, supplies electrical power to the device 1. A main on-off switch 6 controls the supply of power from the battery 8 to the device 1. An operating mode switch 7 switches the operation of the device 1 between a manual and automatic mode. As shown in FIG. 1, the switches 6 and 7 are manually operable toggle switches which are protected on three sides by the construction of the housing 9 to aid in preventing inadvertent operation of the switches 6 and 7. The switches 6 and 7 are designed to be operated from the back of the housing 9. All of the foregoing components are contained within a housing 9 to form a compact, self-contained unit which may be attached to a person's clothing to monitor the movements of the person. The device 1 is light weight and has dimensions on the order of a few inches. The housing 9 is enclosed to prevent smoke and water from contacting the components of the device 1.

Figure 2:
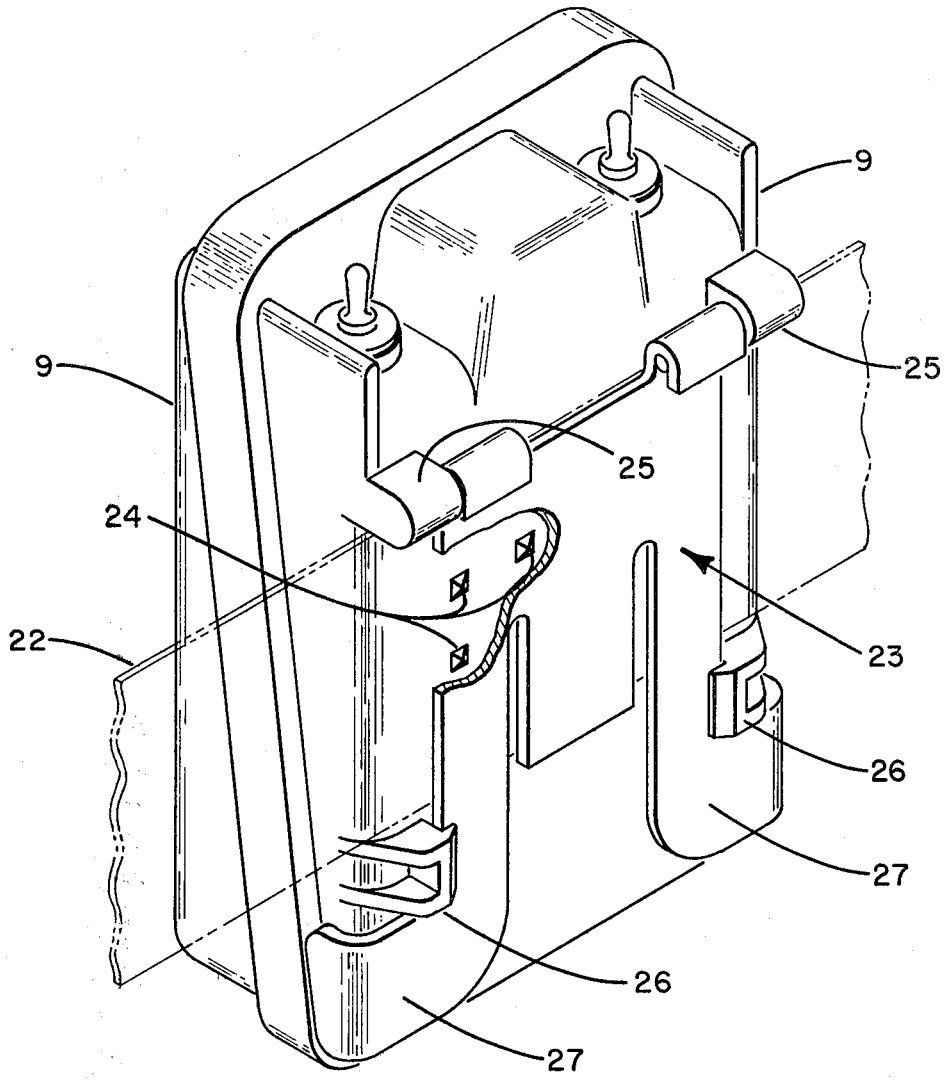
FIG. 2 illustrates the back of the device shown in FIG. 1. A clip for attaching the device to a body whose movements are to be monitored by the device, is shown.

Referring to FIG. 2, the back of the alarm device 1 shown in FIG. 1 is illustrated. A removable hinged plate 23 is provided for attaching the device 1 to either a horizontal belt 22 or a vertical belt (not shown). The belt 22 may be part of a harness worn by a worker such as a fireman or miner. Protrusions 24 are located on the back of the housing 9 to provide a rough surface for contact with the belt 22 to prevent slippage. First, to connect the device 1 to the belt 22, the belt 22 is placed in position next to the back of the housing 9 as shown in FIG. 2. Then, the plate 23 is attached by hinges 25 to the back of the housing 9. The plate 23 snaps into retaining clips 26 to attach the device 1 to the belt 22. The plate 23 may be disengaged from the belt 22 by pushing together legs 27 of the plate 23 to release the plate 23 from the clips 26. Of course, any type of fastener which is suitable for attaching the device 1 to a particular body may be used. The removable hinged plate 23 is only one type of fastener which may be used.

Figure 3:
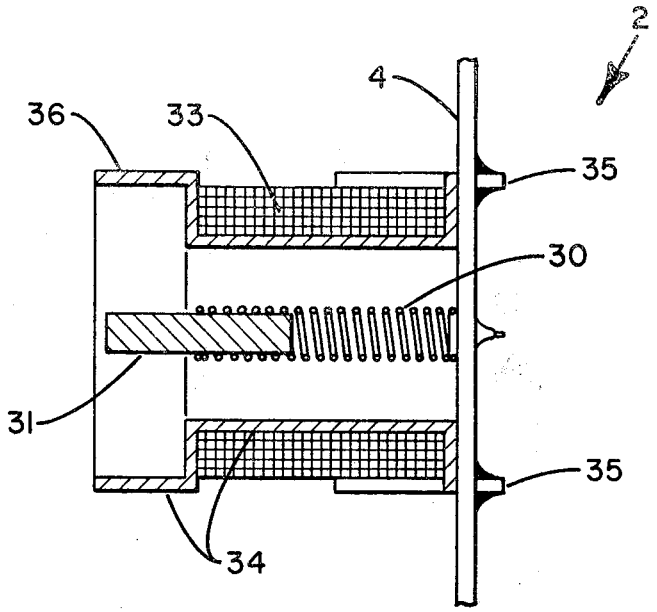
FIG. 3 shows a cross section along the line III—III of the motion sensor shown in FIG. 1.

Referring to FIG. 3, a cross section along the line III—III of the motion sensor 2 shown in FIG. 1, is shown. The motion sensor 2 comprises a bobbin 34, an induction coil 33, a spring 30 and a permanent magnet 31. The induction coil 33 is wound on the bobbin 34. The spring 30 is attached to the printed circuit board 4 at one end and at the other end holds the permanent magnet 31 within the coil 33. Lugs 35 attach the bobbin 34 and the coil 33 to the printed circuit board 4. The bobbin 34 has a top part 36 which is larger in diameter than the other parts of the bobbin 34. Also, coil 33 does not surround the top part 36. The permanent magnet 31 partially extends into the region associated with this part 36. When the sensor 2 is placed in the housing 9, the front wall of the housing 9 and the top part 36 are very close together so that, essentially, the permanent magnet 31 and the spring 30 are enclosed to form a compact motion sensor unit.

Any changes in the magnetic field of the magnet 31 relative to the coil 33 induces a voltage in the coil 33. Thus, the motion sensor 2 has a three axis motion sensing capability. The induced voltage is monitored by a motion sensing circuit 100 (shown in FIG. 4) located on the printed circuit board 4. Factors, such as the size, shape and mass of the spring 30 and the permanent magnet 31, are selected for the particular application of the device 1. For example, factors, such as the number of windings of the coil 33, the stiffness of the spring 30, and mass of the magnet 31, determine the general sensitivity of the motion sensor 2 and these factors may be selected accordingly. A fixed diameter spring 30 is shown in FIG. 3 but a conical type spring or any other type of spring may be used.

Figure 4:
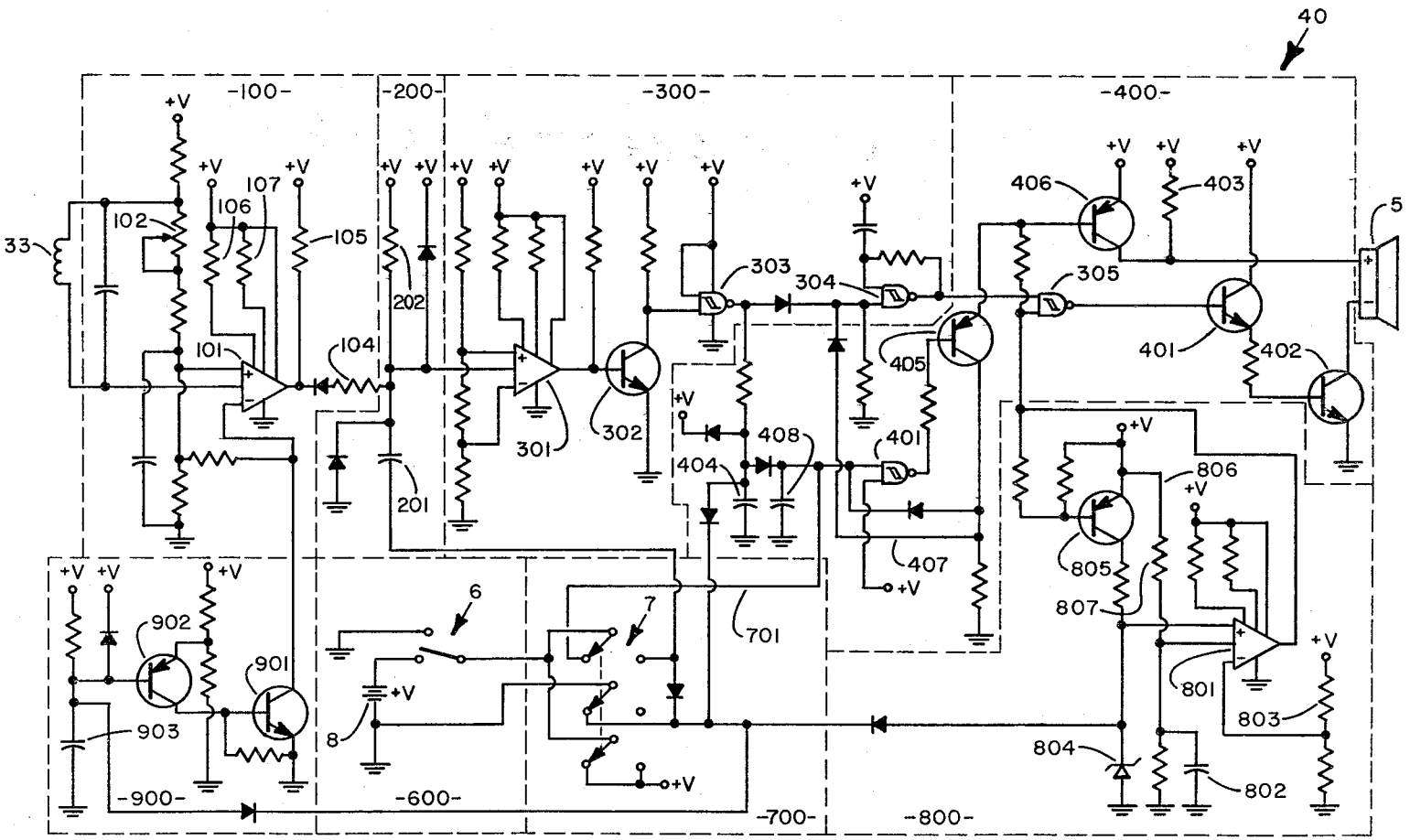
FIG. 4 is a circuit diagram showing specific circuit components for the signal processing circuit of the alarm device shown in FIGS. 1, 2 and 3. This circuit is located on the printed circuit board shown in FIGS. 1 and 3.

Referring to FIG. 4, a signal processing circuit 40 is shown for processing the induced voltages generated by the motion sensor 2 and for generating alarm signals in response to these voltage signals in selected situations. The signal processing circuit 40 comprises a motion sensing circuit 100 and a motion sensor signal processing circuit including a main timer circuit 200, an oscillator circuit 300, a prewarn timer switch circuit 400, a main on-off switch 600, an operating mode switch 700, a test circuit 800, and a motion sensing deactivation circuit 900. Specific circuit components for each of these circuits are shown in FIG. 4.

In operation, the main on-off switch 600 connects the battery 8 to supply power to the signal processing circuit 40. When the switch 600 is in its on state, the switch contact 6 is connected to the positive terminal of battery 8. When the main switch 600 is in its off state the switch contact 6 is connected to ground and no power is supplied from the battery 8 to the circuit 40 thereby rendering the device 1 inoperative. It should be noted that, as shown in FIG. 4, each of the points labeled +V are connected to the positive terminal of the battery 8 when the main on-off switch 600 is in its on state. Each of these points are labeled +V in FIG. 4 to simplify the circuit diagram.

The alarm device 1 is operated in the automatic mode by turning on the main on-off switch 600 when the three switch contacts 7 of the operating mode switch 700 are in contact with the three contact points located on the right in FIG. 4. The switch contacts 7 always are switched together between manual operating mode contact points on the left and the automatic operating mode contact points on the right, as shown in FIG. 4. When the alarm device 1 is operating in the automatic mode, voltages are induced in the coil 33 due to the movement of the permanent magnet 31 relative to the coil 33. This relative motion is caused by movements of the person to which the device 1 is attached. The motion sensing circuit 100 includes a CA3098 type (RCA) Schmitt trigger 101 having its input connected to receive the induced voltage signals from the coil 33 as shown in FIG. 4. The high and low reference voltages for the Schmitt trigger 101 are set by a series of resistors including variable resistor 102. When the signal-input voltage of the Schmitt trigger 101 is equal to or less than the low reference voltage, current flows from an external power supply through an external load, which includes resistors 202 and 104, to the output of the Schmitt trigger 101 which acts as a sink output. Also, power is supplied through resistor 105 to the output of the Schmitt trigger 101 to properly bias the Schmitt trigger 101 when the device 1 is initially turned on and when the device 1 is experiencing other such periods of transient operating conditions. The sink output condition is maintained by the Schmitt trigger 101 until the signal-input voltage rises to or exceeds the high reference voltage to the device 101. This changes the output state of the Schmitt trigger 101 so that the output stage interrupts current flow in the external load. This condition is maintained until such time as the signal again becomes equal to or less than the low reference voltage.

Variable movements of the person to which the device 1 is attached induce variable voltages across the coil 33 resulting in the input voltage to the Schmitt trigger 101 varying over a range of values above and below the high and low reference voltages, respectively, to the Schmitt trigger 101. This results in the output of the Schmitt trigger 101 changing its output state between a sink output and a high level output which interrupts current flow in the external load. The sensitivity of the motion sensing circuit 100 is adjusted easily by varying the resistance setting of the variable resistor 102. This setting is selected so that the motion sensing circuit 100 is sensitive to specific magnitudes of input voltages from the coil 33 corresponding to specific amounts of movement by the person wearing the device 1. The capacitors of the motion sensing circuit 100 act as filters for preventing spurious high frequency voltage signals from affecting operation of the motion sensing circuit 100. The supply power to Schmitt trigger 101 is provided in the usual way through resistors 106 and 107 to ground as shown in FIG. 4.

When the output of the Schmitt trigger 101 is a sink output, charge is prevented from building up at the capacitor 201 of the main timer circuit 200. However, when the signal input voltage to the Schmitt trigger 101 is high, for example, because the person is not moving thereby resulting in no induced voltage across the coil 33, charge builds up at the capacitor 201 to increase the magnitude of the signal-input voltage to Schmitt trigger 301 which is part of oscillator circuit 300. Schmitt trigger 301 is also a CA3098 type (RCA) Schmitt trigger which is connected and operates in the same manner as the Schmitt trigger 101.

There is a time delay associated with the buildup of charge at the capacitor 201 before the high reference voltage of Schmitt trigger 301 is exceeded thereby switching the Schmitt trigger 301 to its high level output state thereby properly biasing the switching transistor 302 to conduct. This time delay is selected so that momentary inactivity by the person whose movements are being monitored, does not result in the generation of an alarm signal by the device 1. For example, the capacitor 201 may be selected so that there is a thirty second delay between the time that the Schmitt trigger 101 achieves a high state and the time that the high reference of Schmitt trigger 301 is exceeded to operate the transistor 302. Other time delays may be selected, if desired, by properly selecting the capacitor 201 and associated circuit components.

The oscillator circuit 300 includes a CD4093 type quad 2-input NAND Schmitt trigger formed by circuit devices 303, 304, 305, and 401 as shown in FIG. 4. Device 303 operates as a switch for devices 304 and 305. One input of the circuit device 303 is maintained at a logical one state (a relatively high level voltage). When the switching transistor 302 is not conducting the other input of the circuit 303 is also at a logical one state resulting in a logical zero state (a relatively low level voltage) output from the circuit device 303. The output from circuit device 303 is supplied to one input of circuit device 304 as shown in FIG. 4. The other input to circuit device 304 is a signal oscillating between a logical zero and a logical one state. Therefore, the output from the circuit device 304 is a logical one whenever the input from circuit device 303 is a logical zero, corresponding to movement of the person.

The signal from circuit device 304 is supplied to one input of circuit device 305 which has a logical one state at its other input because of the operation of test circuit 800 which is described in more detail hereinafter. Therefore, a logical zero output from circuit device 305 is achieved whenever the person is moving thereby preventing transistors 401 and 402 from conducting which in turn prevents a current flow through horn 5 resulting in no alarm signal. However, when the person is not moving, thereby resulting in switching transistor 302 conducting, a logical zero state is supplied to circuit device 304 from circuit device 303 thereby resulting in an oscillating logical zero and one state signal being outputted from the circuit devices 304 and 305. This results in transistors 401 and 402 being switched periodically on and off thereby periodically connecting the battery 8 through resistor 403 to the horn 5 resulting in a low volume pulsating alarm signal.

When the person is not moving and the output from circuit device 303 is a logical one there is a charge buildup at capacitor 404 of the prewarn timer switch circuit 400. After a time delay, determined by the value of the capacitor 404, a logical one input signal appears at the input to the circuit device 401 having a logical one input continuously supplied at its other input from the battery 8. This results in the output from circuit device 401 switching from a logical one state to a logical zero state thereby properly biasing transistors 405 and 406 to conduct. When transistor 406 conducts the battery 8 is connected directly to the horn 5. This results in a high volume pulsating alarm signal being generated by the horn 5. The connection via line 407 between transistor 405 and circuit device 304 causes the high volume alarm signal to lock in once it is initiated. The time delay between the onset of the low volume pulsating alarm signal and the high volume pulsating alarm signal can be adjusted by selecting different capacitance values for the capacitor 404. This time delay is selected so that the person wearing the device 1 has sufficient time to act to deactivate the device 1, before the high volume alarm signal is generated, when the person desires to do so. The diodes and capacitor 408 which are part of prewarn timer switch circuit 400 are included for protective purposes and to facilitate operation of the circuit 400 during transient operating conditions such as associated with turning the device on and off.

In summary, when the operating mode switch 700 is in the automatic position and there is an induced voltage across the coil 33, the motion sensing circuit 100 provides an output changing between a sink output and an output which interrupts current flow in the external load. As long as this changing output exists there is insufficient charge buildup at capacitor 201 of the main timer circuit 200 to activate the oscillator circuit 300. However, if the person stops moving, thereby inducing no voltage across coil 33, a charge buildup occurs at capacitor 201 causing the circuit devices 303, 304 and 305 to operate to generate an oscillating signal at the output of circuit 305 thereby switching the horn 5 on and off to generate a pulsating alarm signal. Initially, a low volume alarm signal is generated. However, after a time delay, which depends upon the value of capacitor 404 of the prewarn timer switch circuit 400, the circuit device 401 is activated to bias the transistors 405 and 406 to conduct thereby increasing the magnitude of the power supplied to the horn 5 to increase the volume of the alarm signal generated by the horn 5.

When the operating mode switch 700 is in the manual position, with the switch contacts 7 contacting the three contact points on the left as shown in FIG. 4, the positive terminal of the battery 8 is connected directly to the input of circuit device 401 via line 701. This connection bypasses the motion sensing circuit 100, main timer circuit 200 and most of the oscillator circuit 300. A logical zero state is generated at the output of circuit device 401 biasing transistors 405 and 406 to their conducting state. A logical one input is supplied via line 407 to the circuit device 304 so that transistors 401 and 402 are periodically turned on and off as described previously. Thus, in the manual mode, the device 1 locks directly into its high volume alarm signal mode of operation and this can only be terminated by turning the device 1 off with the main on-off switch 600 or by switching to the automatic operating mode.

When the device 1 is turned on in the automatic mode the test circuit 800 and motion sensing deactivation circuit 900 operate to check the battery 8 and most other circuit components of the device 1. Another CA3098 type (RCA) Schmitt trigger 801, which is connected and operates in the same manner as Schmitt trigger 101, is used as part of the test circuit 800. The output of the Schmitt trigger 801 is connected to the circuit device 305 of the oscillator circuit 300. Initially, when the device 1 is turned on, the output from the Schmitt trigger 801 is low until sufficient charge builds up on a capacitor 802 to bring the signal-input voltage to the Schmitt trigger 801 above a high reference voltage taken through a resistor 807 directly from the battery 8. With a low output signal from the Schmitt trigger 801 the circuit device 305 generates a logical one state output which biases transistors 401 and 402 to conduct. Also, this low output signal properly biases transistors 805 and 406 to conduct thereby supplying a high reference voltage signal to the Schmitt trigger 801 which is limited in magnitude by the Zener diode 804 and causing a high volume alarm signal to be generated by the horn 5. If the battery 8 is low, sufficient charge cannot build up at capacitor 802 to exceed the high reference voltage of the Schmitt trigger 801 and the device 1 locks into a high level continuous alarm signal. However, if the battery is properly operating the charge buildup at capacitor 802 results in a signal input voltage to the Schmitt trigger 801 which exceeds the high reference voltage signal causing the output voltage of the Schmitt trigger 801 to switch to its high state to interrupt current flow in the external load. By properly selecting the values of the circuit components of the test circuit 800 this operation can occur in a time period whereby a single high volume pulse is emitted by the horn 5 followed by a single low volume pulse as the output from the Schmitt trigger 801 switches from a low to high output.

Once the Schmitt trigger 801 is switched to its high level output state, switching transistor 805 is biased to its nonconducting state and power is connected directly to the input of the Schmitt trigger 801 via line 806 to lock Schmitt trigger 801 in its high output state. A high level output voltage signal is supplied to the input of circuit device 305 continuously thereafter.

During this initial startup period when the device 1 is turned on in the automatic mode, the oscillator circuit 300 is activated and the circuit device 305 generates an output signal changing between a logical zero and a logical one state. This occurs since the deactivation circuit 900 initially supplies a relatively low reference voltage to the Schmitt trigger 101 thereby preventing the motion sensor 3 from effectively controlling the operation of the Schmitt trigger 101. This is accomplished by the operation of the switching transistors 901 and 902 which are biased to their conducting state until sufficient charge builds up at capacitor 903 to prevent these transistors 901 and 902 from conducting. Thus, when the device 1 is initially turned on the oscillator circuit 300 is immediately activated since the capacitor 201 will be fully charged and the Schmitt trigger 101 does not operate to provide a sink output for this charge. This results in the test circuit 800 testing the operation of the components of the oscillator circuit 300, prewarn timer circuit 400, main timer circuit 200, and motion sensing circuit 100 as well as checking the battery 8. Also, after the deactivation circuit 900 switches transistors 901 and 902 from their conducting to nonconducting state, the operation of the motion sensor 2 is checked because if the motion sensor 2 is not operating properly the oscillator circuit 300 continues to oscillate after the motion sensor 2 regains control of the motion sensing circuit 100 and the alarm remains triggered. In this manner, test circuit 800 and deactivation circuit 900 combine to test the battery 8 and most of the circuit components of the device 1 when the device 1 is initially turned on in the automatic mode of operation.

The alarm device 1 described previously is directed to generating an alarm signal in response to the absence of movement of a person to which the device 1 is attached. However, it should be noted that modifications to the device 1 may be made so that the device is useful in a variety of other applications. For example, the prewarn timer switch circuit 400 may be modified by incorporating other switching components so that the horn 5 is activated in response to movements of a body instead of the absence of motion of the body. Then, the device 1 could be used as a security device for detecting unauthorized movements of a body, such as a motor vehicle. Also, a transmitter may be used instead of the horn 5 to send alarm signals to a remote personnel monitoring location. In general, the device 1 may be used as a motion detector which generates a first output voltage signal in response to movement of a body to which the device is attached and a different second output voltage signal in response to the substantial absence of movements of this body. The exact manner of using the output signals generated by the device 1 may vary depending on the situations in which the device 1 is to be utilized. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A device for monitoring the movement of a person or article, comprising:

a first means for providing a magnetic field;

a second means for detecting changes in the magnetic field provided by the first means due to any changes in the position of the first means relative to the second means and for generating an electrical signal varying in magnitude in proportion of the amount of change in the magnetic field which is detected;

a third means for moving the first means relative to the second means in response to movements of the person or article in any direction;

an alarm means for producing an alarm signal when the alarm means is energized;

a circuit means having an adjustable sensitivity, connected between the second means and the alarm means, for processing the electrical signal generated by the second means and for energizing the alarm means when the processed electrical signal meets predetermined conditions;

a means for housing the first means, second means, third means, alarm means, and circuit means to form a selfcontained unit; and a means for attaching the unit to the person or article.

2. A device for monitoring the movement of a person or article as recited in claim 1 wherein the first means comprises a permanent magnet.

3. A device for monitoring the movement of a person or article as recited in claim 2 wherein the third means comprises a coiled spring with one end of the spring connected to the housing means and with the other end of the spring supporting the permanent magnet to move the magnet in response to movements of the person or article.

4. A device for monitoring the movement of a person or article as recited in claim 3 wherein the second means comprises:

a conducting coil sized and positioned relative to the permanent magnet so that movement of the magnet in any direction induces a voltage across the conducting coil.

5. A device for monitoring the movement of a person or article, comprising:

a motion sensing means having a magnetic field sensor for detecting changes in a magnetic field which correspond to movements of the person or article in any direction and for generating a first electrical signal when the person or article is moving and a different, second electrical signal when the person or article is not moving;

an alarm means for producing an alarm signal when the alarm means is energized;

a signal processing means having an adjustable sensitivity, connected between the motion sensing means and the alarm means, for energizing the alarm means in response to one of the electrical signals generated by the motion sensing means and for preventing or terminating energization of the alarm means in response to the other one of the electrical signals generated by the motion sensing means;

a means for housing the motion sensing means, the alarm means, and the signal processing means to form a selfcontained unit; and a means for attaching the unit to the person or article.

6. A device for monitoring the movement of a person or article as recited in claim 5 wherein the signal processing means comprises:

oscillator means for generating a relatively low voltage signal in response to the first electrical signal generated by the motion sensing means and for generating a low-high oscillating voltage signal in response to the second electrical signal generated by the motion sensing means;

main timer means for delaying the generation of the oscillating voltage signal by the oscillator means for a selected time period after the motion sensing means initially generates the second voltage signal;

timer switch means for supplying for a preselected time period a first voltage output signal to energize the alarm means only in response to the high voltage state of the oscillating voltage signal generated by the oscillator means and for supplying a higher, second voltage output signal to energize the alarm means only in response to the high voltage state of the oscillating voltage signal generated by the oscillator means after this preselected time period.

7. A device for monitoring the movement of a person or article as recited in claim 6 wherein the alarm means comprises:

horn means for generating a first pulsating audio alarm signal in response to the first voltage output signal supplied to the horn means from the timer switch means and for generating a higher volume, second pulsating audio alarm signal in response to the higher, second voltage output signal supplied to the horn means from the timer switch means.

8. A device for monitoring the movement of a person or article as recited in claim 7 further comprising:

operating mode switch means, having a first state and a second state, for controlling the operation of the oscillator means and the timer switch means to supply the higher, second voltage output signal directly to the horn means when the operating mode switch means is switched from its first to second state thereby bypassing the main timer means and the timer switch means.

9. A device for monitoring the movement of a person or article as recited in claim 8 further comprising:

on-off main switch means for supplying electrical power to the motion sensing means, the signal processing means, and the alarm means only when the main switch means is in its on-state; and circuit means for testing the operation of the motion sensing means, the signal processing means, and the alarm means when the main switch means is switched from its off-state to its on-state and the operating mode switch means is in its first state.

10. An alarm device for monitoring the movement of a person or article comprising:

a first means having a magnetic field, suspended for movement in any direction in response to movement of the person or article in any direction;

a second means positioned in proximity to the first means to generate electrical pulses in response to any relative change in the magnetic field resulting from movement of the first means;

an electrical sensing and signal generating circuit with an adjustable sensitivity connected to the second means to detect pulse changes created in response to movement of the magnetic field and to create a first signal when the magnetic field does not substantially change and a different second signal upon change in the magnetic field;

an alarm device for producing a detectable warning signal;

a signal processing circuit connected between the signal generating circuit and the alarm device to energize the alarm device in response to the first signal and to prevent or terminate energization of the alarm device in response to the second signal; and housing means, adapted for mounting on the person or article, containing the first means, the second means, the motion sensing and signal generating circuit, the signal processing circuit, and the alarm device.

* * * * *